US011724780B2

(12) United States Patent
Oh et al.

(10) Patent No.: US 11,724,780 B2
(45) Date of Patent: Aug. 15, 2023

(54) SONOBUOY CARTRIDGE PERCUSSION APPARATUS

(71) Applicant: SONARTECH CO., LTD., Busan (KR)

(72) Inventors: Young Seock Oh, Busan (KR); Seung Soo Park, Busan (KR)

(73) Assignee: SONARTECH CO., LTD., Busan (KR)

( * ) Notice: Subject to any disclaimer, the term of this patent is extended or adjusted under 35 U.S.C. 154(b) by 223 days.

(21) Appl. No.: 17/383,046

(22) Filed: Jul. 22, 2021

(65) Prior Publication Data

US 2023/0024590 A1 Jan. 26, 2023

(51) Int. Cl.

| | |
|---|---|
| ***B63B 22/00*** | (2006.01) |
| ***B63B 22/22*** | (2006.01) |
| ***G10K 11/00*** | (2006.01) |

(52) U.S. Cl.

CPC ..... *B63B 22/003* (2013.01); *B63B 22/22* (2013.01); *G10K 11/006* (2013.01); *B63B 2022/006* (2013.01); *B63B 2209/10* (2013.01)

(58) Field of Classification Search

CPC . B63B 22/003; B63B 22/22; B63B 2022/006; B63B 2209/10; G10K 11/006

See application file for complete search history.

(56) References Cited

U.S. PATENT DOCUMENTS

| | | | | |
|---|---|---|---|---|
| 3,006,002 A * | 10/1961 | Pingree | B63B 51/04 367/4 |
| 4,020,514 A * | 5/1977 | Bourgeois | B63B 22/003 367/4 |
| 9,841,145 B1 * | 12/2017 | Powell | F17C 1/005 |
| 11,591,050 B2 * | 2/2023 | Graham | B63B 22/24 |

FOREIGN PATENT DOCUMENTS

| | | | |
|---|---|---|---|
| EP | E P-449371 A * | 10/1991 | B63B 22/003 |
| KR | 10-1141522 B1 | 5/2012 | |

* cited by examiner

*Primary Examiner* — Ian J Lobo

(74) *Attorney, Agent, or Firm* — Stein IP, LLC

(57) ABSTRACT

Disclosed herein is a sonobuoy cartridge percussion apparatus. A sonobuoy cartridge percussion apparatus according to an aspect of the present invention includes: a $CO_2$ cartridge filled with $CO_2$ gas; a percussion ram configured to hit one end of the $CO_2$ cartridge; a spring configured to enable the percussion ram to hit the $CO_2$ cartridge by applying force to the percussion ram; a $CO_2$ cartridge fastening body configured such that a spring reception hole is formed therein to enable the spring to be compressed and inserted into the spring reception hole; and a thread-shaped fastening member configured such that one end thereof is wound around the percussion ram and the other end thereof is passed through the spring reception hole, wherein the fastening member compresses the spring, and is fastened to a stop protrusion formed on the $CO_2$ cartridge fastening body.

3 Claims, 9 Drawing Sheets

SONOBUOY CARTRIDGE PERCUSSION APPARATUS

BACKGROUND

1. Technical Field

The present invention relates to a sonobuoy cartridge percussion apparatus.

2. Description of the Related Art

In order to detect underwater targets such as submarines, acoustic signals are mainly used. Various technologies, such as sonobuoys, surface ship- and submarine-mounted sonar systems, towed array sonar systems (TASSs), and hull mounted sonar (HMS) harbor monitoring systems, are used to detect targets located underwater using acoustic signals.

Among the above-described apparatuses, sonobuoys are buoys equipped with a hydrophone and a transmitter to detect targets active in the water, and are classified into active sonar buoys and passive sonar buoys. In connection with the sonobuoys, Korean Patent No. 10-1141522 discloses an underwater target technology using a sonobuoy.

For the installation and operation of a sonobuoy, there is preferably provided a sonar system including a projectile configured such that the sonobuoy is mounted therein, a launcher configured to throw the sonobuoy to a suspected underwater target appearance area by detonating the projectile, and an acoustic wave receiver configured to receive acoustic waves radiated from the thrown sonobuoy. In order to install the sonobuoy at a location where detection is required, it is preferable that the projectile include a sonobuoy mounting portion configured such that the sonobuoy is mounted therein, a charging portion configured to store an explosive charge providing explosive power when the projectile is detonated, and a buffer portion provided between the sonobuoy mounting portion and the charging portion and configured to protect the sonobuoy mounting portion when the projectile is detonated Since the detection range of the sonobuoy is considerably influenced depending on a spatial/temporal change in a marine environment and the depth of the water to which a target to be detected is located, it is important to install it without error in operation.

To this end, it is necessary to accurately install the sonobuoy. When a sonobuoy cartridge percussion apparatus provided in the conventional sonobuoy is changed or a new sonobuoy cartridge percussion apparatus is installed, the cost is increased, which is not preferable.

However, the sonobuoy cartridge percussion apparatus using $CO_2$ cartridges used in the conventional sonobuoy cartridge percussion apparatus is problematic due to a method of discharging $CO_2$ gas and an ice phenomenon occurring when $CO_2$ gas is discharged. In this case, the ice phenomenon is a phenomenon in which water and ice crystals are formed due to the difference between the temperature of air in the $CO_2$ cartridges and room temperature when the $CO_2$ cartridges of the sonobuoy are burst. Therefore, there is a need for a sonobuoy cartridge percussion apparatus that may overcome these problems.

SUMMARY

The technical spirit of the present disclosure intends to overcome the above-described problems, and an object of the present disclosure is to provide a technology that may, in a sonobuoy cartridge percussion apparatus, smoothly discharge $CO_2$ gas contained in a $CO_2$ cartridge and prevent an ice phenomenon occurring when $CO_2$ gas is discharged.

Another object of the present disclosure is to provide a technology that may prevent a reduction in the discharge rate of $CO_2$ gas and erroneous operation attributable to an ice phenomenon when a $CO_2$ cartridge is hit with a percussion ram.

According to an aspect of the present invention, there is provided a sonobuoy cartridge percussion apparatus including: a $CO_2$ cartridge filled with $CO_2$ gas; a percussion ram configured to hit one end of the $CO_2$ cartridge; a spring configured to enable the percussion ram to hit the $CO_2$ cartridge by applying force to the percussion ram; a $CO_2$ cartridge fastening body configured such that a spring reception hole is formed therein to enable the spring to be compressed and inserted into the spring reception hole; and a thread-shaped fastening member configured such that one end thereof is wound around the percussion ram and the other end thereof is passed through the spring reception hole, wherein the fastening member compresses the spring, and is fastened to a stop protrusion formed on the $CO_2$ cartridge fastening body; wherein when the fastening member is broken by a heating resistor that generates heat, the percussion ram receives the elastic force of the spring, and thus hits one end of the $CO_2$ cartridge so that the $CO_2$ gas inside the $CO_2$ cartridge is discharged.

The percussion ram may include: a percussion ram body portion configured such that a fastening member through hole is formed therethrough; a percussion ram protrusion portion formed to protrude in one direction from the percussion ram body portion; and a hitting portion formed to protrude in the other direction from the percussion ram body portion in an elliptical shape or U-shape with the hollow end thereof inclined, and configured to hit the $CO_2$ cartridge.

The spring reception hole configured to receive the spring may be formed in the $CO_2$ cartridge fastening body, and a gas discharge hole may be formed in a direction perpendicular to the spring reception hole to communicate with the spring reception hole.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Embodiments to be described below are provided such that those skilled in the art can easily understand the technical spirit of the present invention, and the present invention is not limited thereto. In addition, the items shown in the accompanying drawings are schematically illustrated to easily describe the embodiments of the present invention, and may be different from the forms actually implemented in practice.

When a component is referred to as being connected or coupled to another component, it should be understood that the other component may be directly connected or coupled to the other component but another component may be present between the two components.

Figure 1:
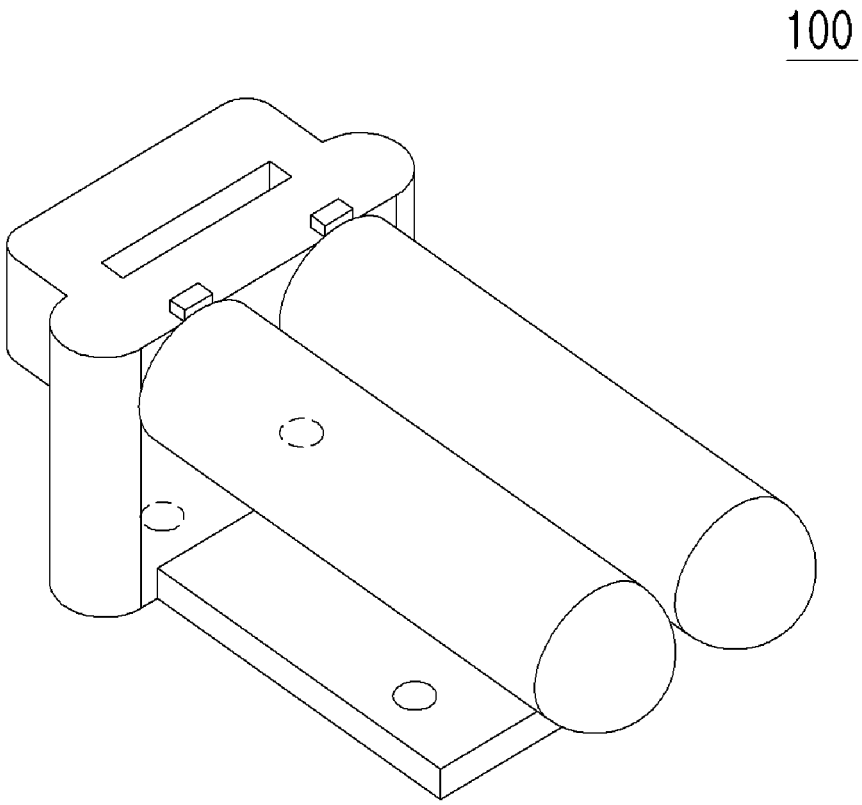
FIG. 1 is a schematic diagram of a sonobuoy cartridge percussion apparatus according to an embodiment of the present invention.
Figure 2:
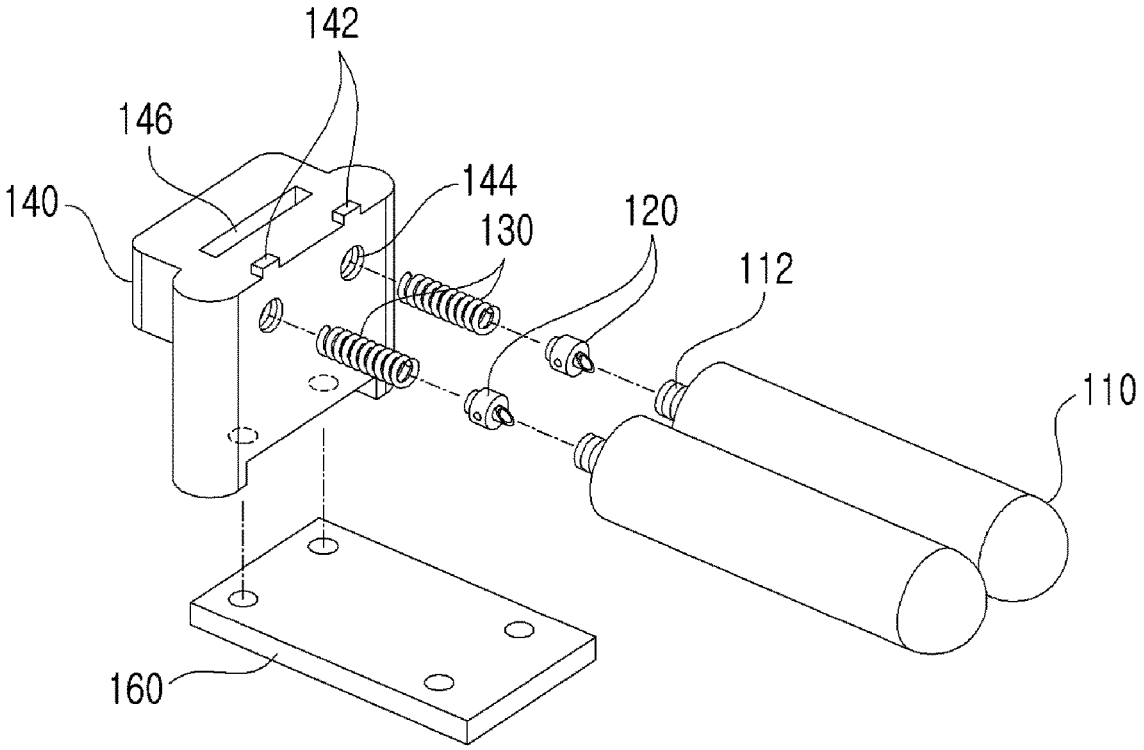
FIG. 2 is an exploded perspective view of the sonobuoy cartridge percussion apparatus shown in FIG. 1.

FIG. 1 is a schematic diagram of a sonobuoy cartridge percussion apparatus according to an embodiment of the present invention, and FIG. 2 is an exploded perspective view of the sonobuoy cartridge percussion apparatus shown in FIG. 1.

Referring to FIGS. 1 and 2, the sonobuoy cartridge percussion apparatus 100 according to the present embodiment is directed to a sonobuoy cartridge percussion apparatus for the installation of a sonobuoy. The sonobuoy cartridge percussion apparatus 100 includes: $CO_2$ cartridges 110 filled with $CO_2$ gas; percussion rams 120 configured to hit the one-side ends of the $CO_2$ cartridges 110; springs 130 configured to enable percussion rams to hit the $CO_2$ cartridges 110 by applying force to the percussion rams 120; a $CO_2$ cartridge fastening body 140 configured such that spring reception holes 144 are formed therein to enable the springs 130 to be compressed and inserted into the spring reception holes 144, respectively; and thread-shaped fastening members 150 configured such that one-side ends thereof are wound around the percussion rams, respectively, and the other-side ends thereof are passed through the spring reception holes 144, respectively, compress the springs 130, respectively, and are fastened to stop protrusions 142, respectively, that are formed on the $CO_2$ cartridge fastening body 140.

According to the present embodiment, when the fastening members 150 are broken, the percussion rams 120 receive the elastic force of the springs 130, and thus hit the one-side ends of the $CO_2$ cartridges 110 so that the $CO_2$ gas inside the $CO_2$ cartridges 110 is discharged. Gases other than $CO_2$ gas may be employed in the present invention.

The $CO_2$ cartridges 110 have hollow cylindrical shapes, and have a form in which two cartridges are attached side by side with respect to a plane. In addition, the parts of the $CO_2$ cartridges 110 other than the one-side ends 112 thereof that are hit by the percussion rams 120 are made of steel. The percussion rams 120 are configured to receive the elastic force of the compressed springs 130 and hit the one-side ends of the $CO_2$ cartridges 110.

In addition, the one-side ends 112 of the $CO_2$ cartridges 110 are fastened into spring reception holes 144, respectively, that are formed in the $CO_2$ cartridge fastening body 140. The one-side ends 112 of the $CO_2$ cartridges 110 are threaded and screwed into the spring reception holes 144, respectively.

The pluralities of percussion rams 120 and springs 130 are spaced apart to hit the one-side ends 112 of the $CO_2$ cartridges 110 in accordance with the form of the $CO_2$ cartridges 110. The springs 130 are coupled into the spring reception holes 144 formed in a $CO_2$ cartridge fastening body 140, and preferably have coil spring shapes.

Figure 3:
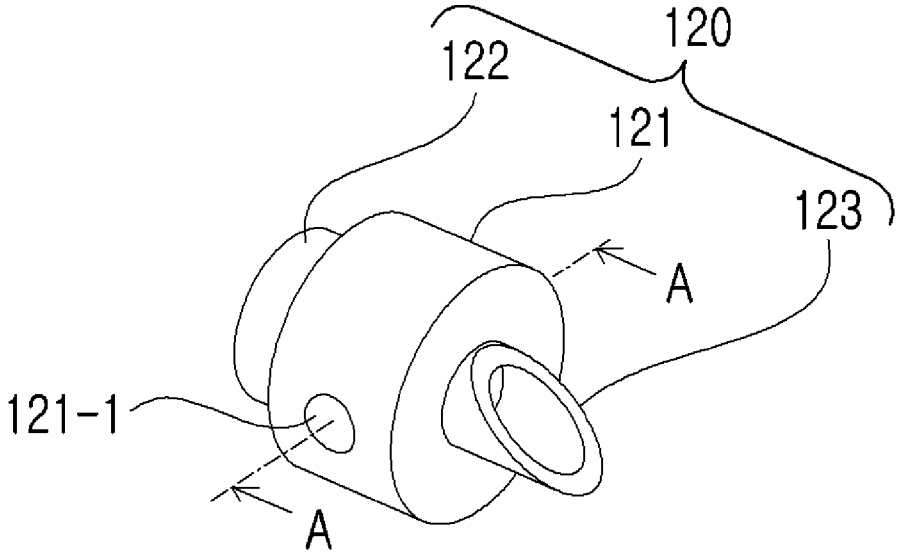
FIG. 3 is a perspective view showing a percussion ram of a sonobuoy cartridge percussion apparatus according to an embodiment of the present invention.
Figure 4:
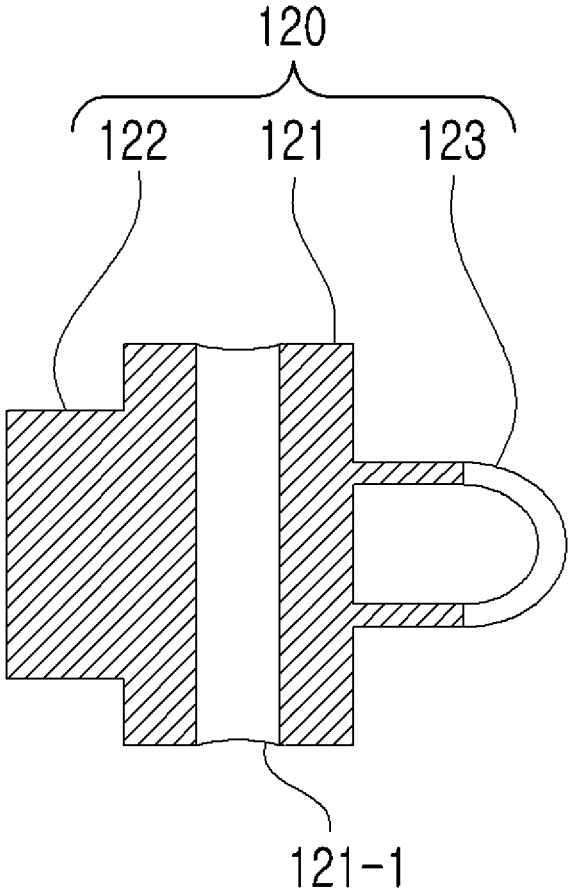
FIG. 4 is a schematic sectional view taken along line A-A of FIG. 3.

FIG. 3 is a perspective view showing a percussion ram of a sonobuoy cartridge percussion apparatus according to an embodiment of the present invention, and FIG. 4 is a schematic sectional view taken along line A-A of FIG. 3.

Referring to FIGS. 3 and 4 together with FIGS. 1 and 2, the percussion ram 120 includes: a percussion ram body portion 121 configured such that a fastening member through hole 121-1 is formed therethrough; a percussion ram protrusion portion 122 formed to protrude in one direction from the percussion ram body portion 121; and a hitting portion 123 formed to protrude in the other direction from the percussion ram body portion 121 in an elliptical shape or U-shape with a hollow end thereof inclined, and configured to hit the $CO_2$ cartridge 110.

In one specific example, it is preferable that the diameter of the percussion ram body portion 121 be smaller than the diameter of the spring reception hole 144 formed in the $CO_2$ cartridge fastening body 140 and the diameter of the percussion ram protrusion portion 122 be larger than the diameter of the spring 130.

Furthermore, the hitting portion 123 has a hollow elliptical shape in which one end surface thereof is inclined and a hole is formed in the center thereof. The reason for this is to make the discharge of the $CO_2$ gas inside the $CO_2$ cartridge 110 as smooth as possible.

In other words, in order to prevent the problem in which the percussion ram 120 is stuck in the $CO_2$ cartridge 110 when it hits the $CO_2$ cartridge 110, so that the fluid is not discharged from the $CO_2$ cartridge 110, the percussion ram 120 is inclined in an elliptical shape or U-shape so that the fluid can be discharged smoothly, thereby preventing erroneous operation.

Figure 5:
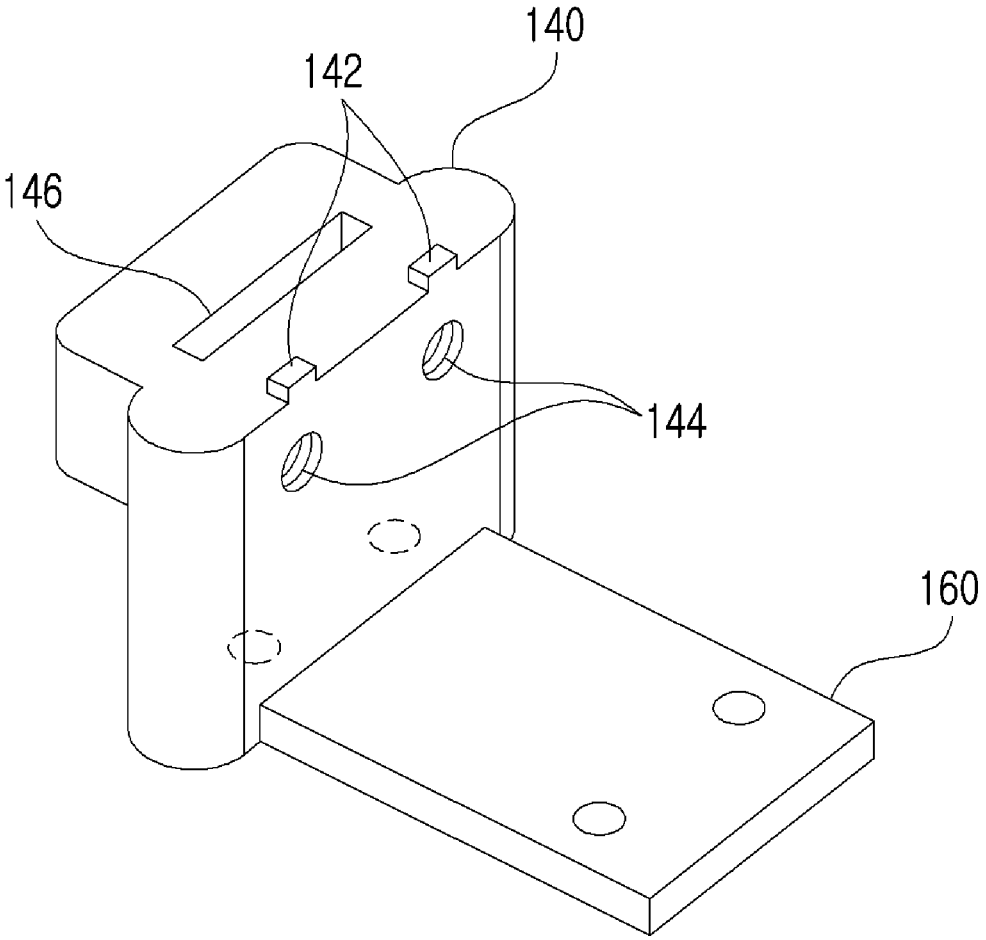
FIG. 5 is a schematic view showing a state in which a bottom plate jig is coupled to a $CO_2$ cartridge fastening body.
Figure 6:
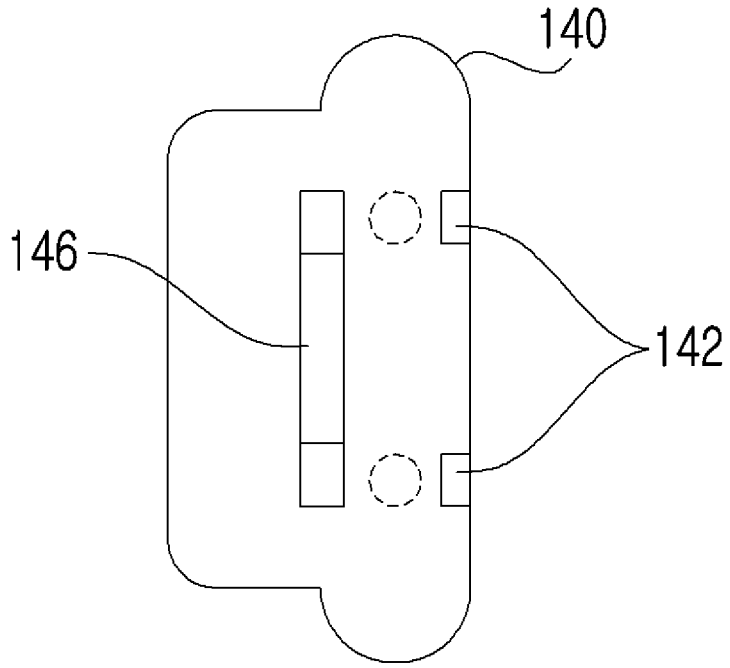
FIG. 6 is a schematic plan view of the $CO_2$ cartridge fastening body.

FIG. 5 is a schematic diagram showing a state in which a bottom plate jig is coupled to the $CO_2$ cartridge fastening body, and FIG. 6 is a schematic plan view of the $CO_2$ cartridge fastening body.

Referring to FIGS. 5 and 6 together with FIGS. 1 to 4, when the surface of the $CO_2$ cartridge fastening body 140 to which the springs 130 are coupled is set to a front surface, the spring reception holes 144 are formed through the front surface of the $CO_2$ cartridge fastening body 140 and a $CO_2$ discharge hole 146 communicating with the spring reception holes 144 is formed through the top surface of the $CO_2$ cartridge fastening body 140, so that the $CO_2$ gas inside the $CO_2$ cartridge 110 can be smoothly discharged. The $CO_2$ discharge hole 146 is intended to prevent an ice phenomenon occurring when the $CO_2$ gas inside the $CO_2$ cartridge 110 is discharged.

Furthermore, the bottom plate jig 160 is coupled to the bottom end of the $CO_2$ cartridge fastening body 140 in order to fasten the sonobuoy cartridge percussion apparatus 100 to an apparatus that is equipped with the sonobuoy cartridge percussion apparatus 100.

Figure 7:
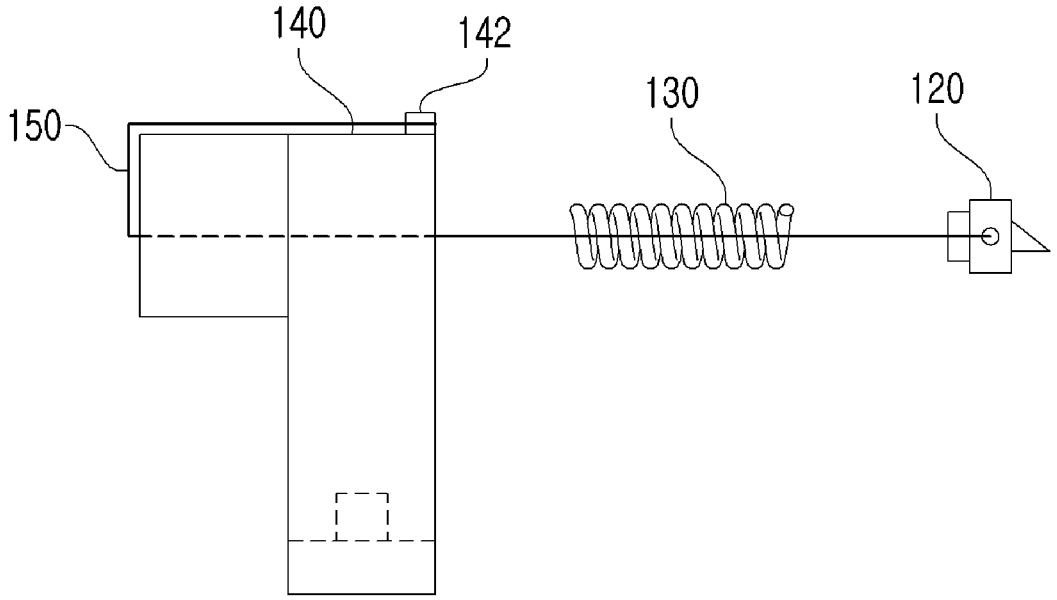
FIG. 7 is a schematic diagram showing a state in which a percussion ram and a spring are fastened to the $CO_2$ cartridge fastening body using a thread-shaped fastening member.

FIG. 7 is a schematic diagram showing a state in which the percussion ram and the spring are fastened to the $CO_2$ cartridge fastening body using a corresponding one of the thread-shaped fastening members.

Referring to FIG. 7 together with FIGS. 1 to 6, one end of each of the fastening members 150 is fastened to the percussion ram 120, and then the other end of the fastening member 150 is passed through the central portion of the spring 130 and then the spring insertion hole 144 of the $CO_2$ cartridge fastening body 140 and is fastened to a stop protrusion 142 formed on the top surface of the $CO_2$ cartridge fastening body 140.

In this case, although the fastening member 150 is passed through the spring reception hole 144, the percussion ram 120 and the spring 130 are not passed through the spring reception hole 144, and the spring 130 is inserted and compressed into the spring reception hole 144. The fastening member 150 is composed of, e.g., a thread, but may be made of plastic material that is melt by heat.

Figure 8:
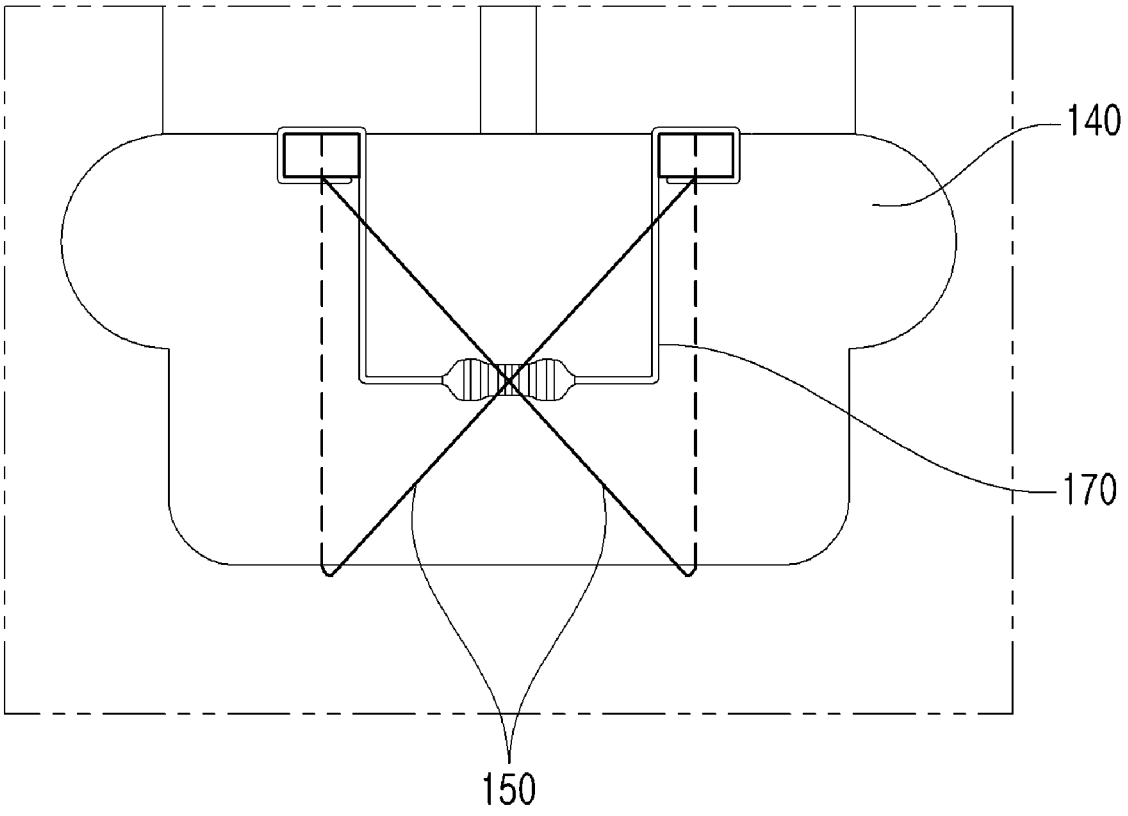
FIG. 8 is a schematic diagram showing a heating resistor configured to break fastening members.

FIG. 8 is a schematic diagram showing a heating resistor configured to break fastening members.

Referring to FIG. 8 together with FIGS. 2 and 7, parts of the fastening members 150 are passed over the heating resistor 170 while in contact with the heating resistor 170. One-side ends of the plurality of fastening members 150, the other-side ends of which are coupled to the $CO_2$ cartridges 110, respectively, are passed through $CO_2$ cartridge fastening body 140, intersect each other, and are then fastened to the stop protrusions 142, respectively.

The heating resistor 170 is placed at a location where the fastening members 150 intersect each other. It is preferable that both ends of the heating resistor 170 be wound and fastened respectively on the $CO_2$ stop protrusions 142 of the cartridge fastening body 140.

When the heating resistor 170 operates and generates heat, the fastening members 150 are broken by heat, and thus the elastic force of the compressed springs 130 is transferred to the percussion rams 120.

Meanwhile, a power supply configured to supply power to the heating resistor 170 and a control device configured to control components may be further included.

Figure 9:
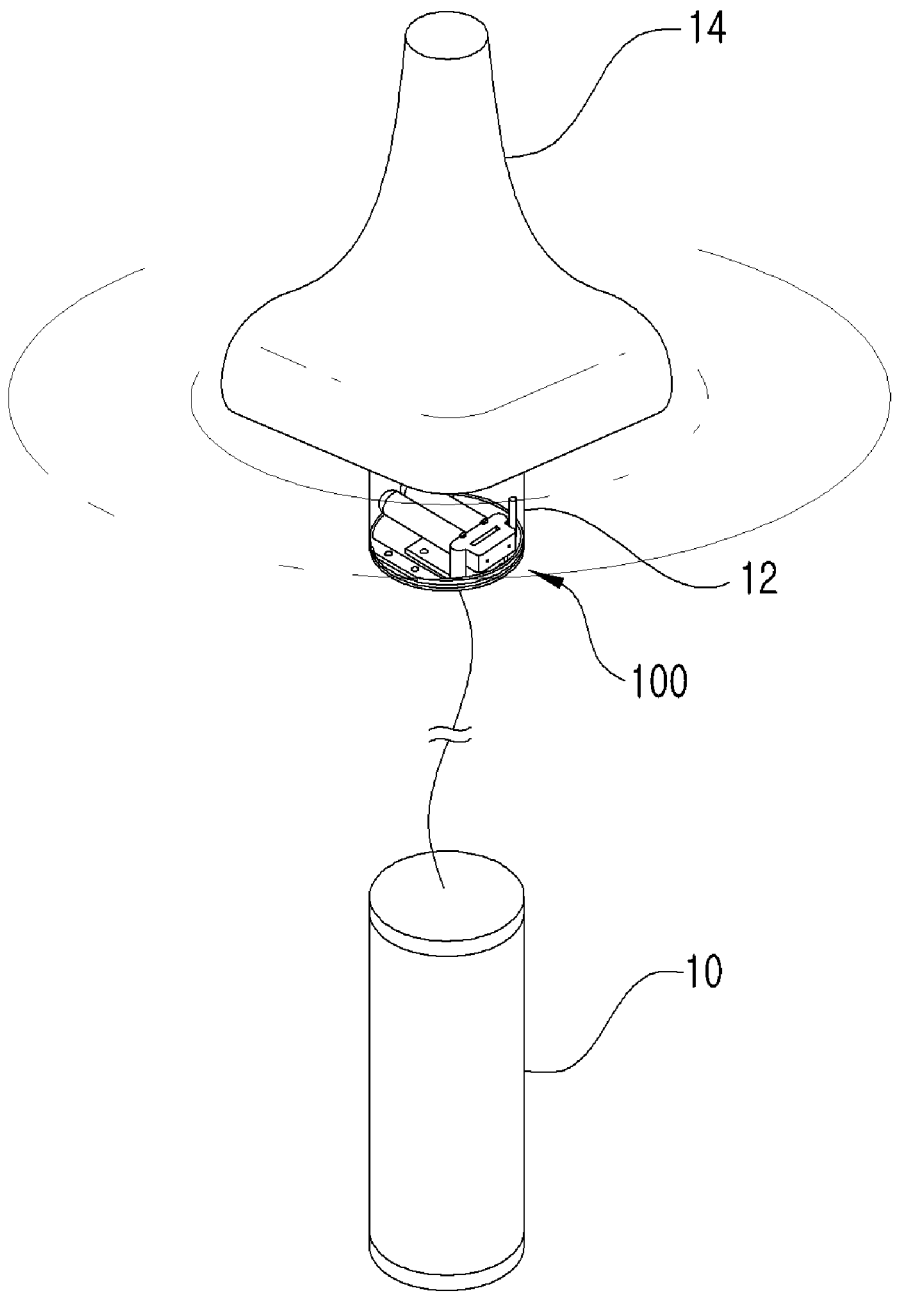
FIG. 9 is a schematic diagram showing the operation of a sonobuoy cartridge percussion apparatus according to an embodiment of the present invention.

FIG. 9 is a schematic diagram showing the operation of a sonobuoy cartridge percussion apparatus according to an embodiment of the present invention.

Referring to FIG. 9 together with FIGS. 2 and 7, as an example of operation, the sonobuoy cartridge percussion apparatus 100 is mounted in a sonobuoy main body 10 and coupled to one side of a housing 12 covering the sonobuoy cartridge percussion apparatus 100, and the other side of the housing 12 is coupled to the bottom portion of a buoy 14. The sonobuoy cartridge percussion apparatus 100 is fastened to the bottom plate jig 160, provided at the lower end of the sonobuoy cartridge percussion apparatus 100, by using bolts, is operated at a location where detection is required, and is moved along with the housing 12 and the buoy 14.

The operation of the sonobuoy cartridge percussion apparatus 100 according to the present invention is now described with reference to the accompanying drawings. Each of the fastening members 150 is fastened to the fastening member through hole 121-1 formed through the percussion ram body portion 121 of a corresponding one of the percussion rams 120 by forming a knot. It is preferred that the knot be located on one end surface of the percussion ram protrusion portion 122 of the percussion ram 120.

When one end of the fastening member 150 is fastened to the percussion ram 120, the other end of the fastening member 150 is passed through the central portion of a corresponding one of the springs 130, and is then passed through a corresponding one of the spring reception holes 144 formed in the $CO_2$ cartridge fastening body 140. Accordingly, the other end of the fastening member 150 is stuck on a corresponding one of the stop protrusions 142 that protrude from the top surface of the $CO_2$ cartridge fastening body 140.

In this case, the spring 130 together with the percussion ram 120 is inserted into the spring reception hole 144 in the state of being compressed by the percussion ram 120, and also the one end 112 of a corresponding one of the $CO_2$ cartridges 110 enters a state of being inserted into the spring reception hole 144.

In addition, the bottom plate jig 160 is coupled to the lower end of the $CO_2$ cartridge fastening body 140 so that the sonobuoy cartridge percussion apparatus 100 can be mounted in the provided sonobuoy main body 10.

In this state, when the heating resistor 170 is operated at a location where detection is required so that the fastening members 150 are heated and broken by heat, the percussion rams 120 hit the one-side ends 112 of the $CO_2$ cartridges 110 by means of the elastic force of the springs 130, so that the $CO_2$ cartridges 110 are burst.

Accordingly, the $CO_2$ gas inside the $CO_2$ cartridges 110 is discharged through the spring reception holes 144 and the $CO_2$ discharge hole 146 and is then injected into the buoy 12 similar to a balloon, so that the sonobuoy main body 10 can start detection at the location where detection is required.

Therefore, the sonobuoy cartridge percussion apparatus 100 according to the present invention may smoothly discharge the $CO_2$ gas inside the $CO_2$ cartridges, may prevent the occurrence of an ice phenomenon when the $CO_2$ gas is discharged, and may burst the $CO_2$ cartridges by accurately hitting the centers of the $CO_2$ cartridges, thereby considerably preventing the occurrence of erroneous operations.

As described above, according to the present invention, $CO_2$ gas inside the $CO_2$ cartridges may be smoothly discharged, and an ice phenomenon may be prevented from occurring when $CO_2$ gas is discharged.

Furthermore, the $CO_2$ cartridges may be burst by accurately hitting the centers of the $CO_2$ cartridges.

Moreover, operation errors may be prevented from occurring when a sonobuoy is installed.

Effects according to various embodiments of the present invention are not limited to the effects mentioned above, and other effects that are not mentioned will be clearly understood by those skilled in the art from the description of the claims.

While the foregoing detailed description of the present invention has been made in conjunction with the embodiments given with reference to the accompanying drawings, the above-described embodiments are merely examples of the present invention. Therefore, it should not be understood that the present invention is limited only to the above-described embodiments, and the scope of the present invention should be understood as encompassing the attached claims and equivalents thereto.

What is claimed is:

1. A sonobuoy cartridge percussion apparatus comprising:

a $CO_2$ cartridge filled with $CO_2$ gas;

a percussion ram configured to hit one end of the $CO_2$ cartridge;

a spring configured to enable the percussion ram to hit the $CO_2$ cartridge by applying force to the percussion ram;

a $CO_2$ cartridge fastening body configured such that a spring reception hole is formed therein to enable the spring to be compressed and inserted into the spring reception hole; and a thread-shaped fastening member configured such that one end thereof is wound around the percussion ram and a remaining end thereof is passed through the spring reception hole, wherein the fastening member compresses the spring, and is fastened to a stop protrusion formed on the $CO_2$ cartridge fastening body;

wherein when the fastening member is broken by a heating resistor that generates heat, the percussion ram receives elastic force of the spring, and thus hits one end of the $CO_2$ cartridge so that the $CO_2$ gas inside the $CO_2$ cartridge is discharged.

2. The sonobuoy cartridge percussion apparatus of claim 1, wherein the percussion ram comprises:

a percussion ram body portion configured such that a fastening member through hole is formed therethrough;

a percussion ram protrusion portion formed to protrude in one direction from the percussion ram body portion; and a hitting portion formed to protrude in an opposite direction from the percussion ram body portion in an elliptical shape or U-shape with a hollow end thereof inclined, and configured to hit the $CO_2$ cartridge.

3. The sonobuoy cartridge percussion apparatus of claim 1, wherein the spring reception hole configured to receive the spring is formed in the $CO_2$ cartridge fastening body, and a gas discharge hole is formed in a direction perpendicular to the spring reception hole.

* * * * *